US005083691A

United States Patent [19]

Handrick

[11] Patent Number: 5,083,691

[45] Date of Patent: Jan. 28, 1992

[54] GARMENT HANGER WITH SPLIT ARMS AND SLIDING ARM CLAMP

[76] Inventor: Rick Handrick, 711 N. Cedar, Marshfield, Wis. 54449

[21] Appl. No.: 492,890

[22] Filed: Mar. 12, 1990

[51] Int. Cl.[5] ..... A47G 25/48; A47G 25/14

[52] U.S. Cl. ..... 223/96; 223/91; 223/93; 223/95; 223/85; D6/326; D6/315

[58] Field of Search ..... 223/96, 95, 91, 90, 223/93, 85, 88; D6/326, 315; 211/113, 116

[56] References Cited

U.S. PATENT DOCUMENTS

| | | | |
|---|---|---|---|
| D. 183,640 | 9/1958 | Van Dusen . | |
| D. 190,403 | 5/1961 | Van Dusen . | |
| 365,881 | 7/1887 | Taylor . | |
| 472,508 | 4/1892 | Perkins . | |
| 1,112,775 | 10/1914 | Crutcher . | |
| 1,689,373 | 10/1928 | Weinberg . | |
| 1,863,649 | 6/1932 | Bliss . | |
| 2,209,864 | 7/1940 | Warren | 223/96 |
| 2,213,537 | 9/1940 | Stevens . | |
| 2,214,536 | 9/1940 | Nelson . | |
| 2,413,798 | 1/1947 | Strassburg . | |
| 2,431,976 | 12/1947 | Ajax | 223/96 |
| 2,580,493 | 1/1952 | Weiss . | |
| 2,776,789 | 1/1957 | Olpe | 223/96 |
| 2,797,031 | 6/1957 | Emmerling . | |
| 3,013,706 | 12/1961 | Morton . | |
| 3,050,222 | 8/1962 | Cates | 223/96 |
| 3,061,155 | 11/1962 | Van Dusen . | |
| 3,603,491 | 9/1971 | Weight . | |
| 3,972,455 | 8/1976 | Collins | 223/96 |
| 4,177,908 | 12/1979 | Batts et al. | 223/96 |
| 4,275,826 | 6/1981 | Lessard | 223/96 |
| 4,556,158 | 12/1985 | Blanchard et al. . | |

FOREIGN PATENT DOCUMENTS

| | | | |
|---|---|---|---|
| 1220830 | 1/1971 | United Kingdom | 223/96 |

*Primary Examiner*—Andrew M. Falik
*Assistant Examiner*—Bibhu Mohanty
*Attorney, Agent, or Firm*—Andrus, Sceales, Starke & Sawall

[57] ABSTRACT

A garment hanger is provided with a hook portion, a body portion, and a lower portion including a pair of legs. The legs each include lower transverse portions adapted to receive a garment therebetween. The hook is preferably engagable with a rod or the like in such a manner so as to securely clamp the hanger to the rod, so as to prevent its movement after mounting thereto. A clamping sleeve is provided on the body portion and movable into and out of engagement with the upper ends of the legs, so as to selectively move the legs between a clamping position and a release position.

11 Claims, 1 Drawing Sheet

GARMENT HANGER WITH SPLIT ARMS AND SLIDING ARM CLAMP

BACKGROUND AND SUMMARY

This invention relates to a hanger for hanging a garment from a rod or the like.

In accordance with the hanger of the invention, a hook portion is provided for placement on a rod for suspending the hanger therefrom. An intermediate body portion is connected at its upper end to the hook portion, and a pair of substantially parallel legs extend from the body portion. The legs are adapted to receive a garment therebetween. Selectively engagable clamping means is provided for selectively exerting a clamping force on the garment by urging the legs toward each other. The clamping means is releasable for releasing the clamping force on the legs, for facilitating withdrawal of the garment from the hanger. Additionally, the clamping means allows proper adjustment for the characteristics of a particular garment.

In a preferred embodiment, the hook portion is dimensioned so as to securely engage the rod, for preventing longitudinal or rotational movement of the hanger relative to the rod after the hook is engaged therewith.

The clamping means preferably comprises a sleeve slidably mounted to the intermediate body portion and selectively movable over the legs adjacent their connection to the body portion, for urging the legs toward each other.

The invention further contemplates various features associated with the legs for aiding in inserting the garment on the hanger and removing the garment therefrom, and for facilitating effective clamping of the garment between the legs.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
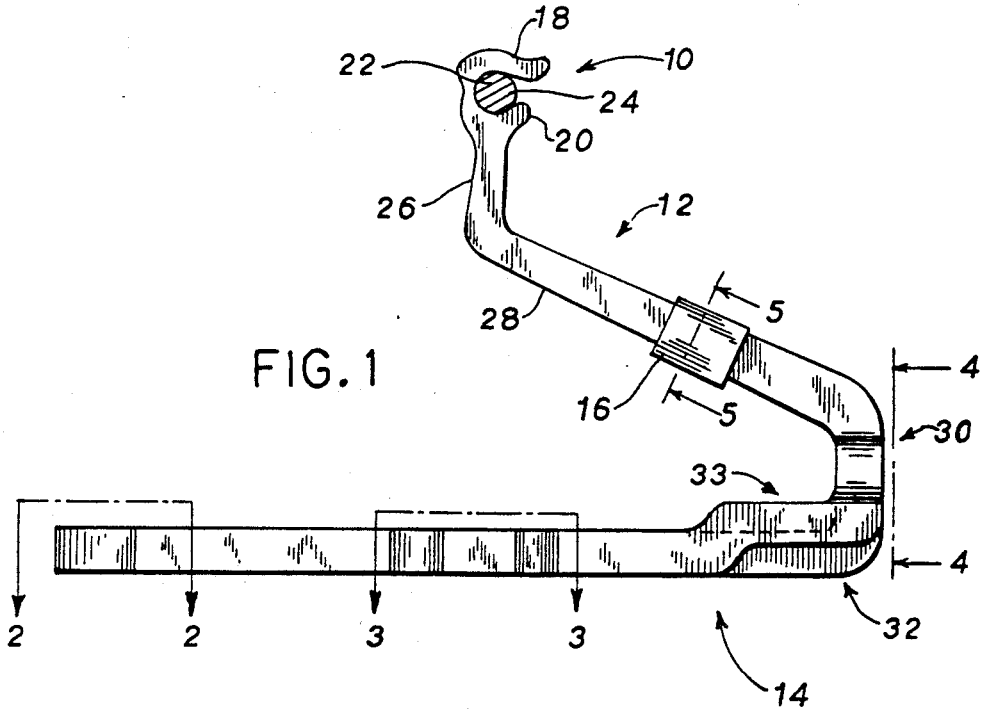
FIG. 1 is a side elevation view showing the hanger of the invention.

Referring to FIG. 1, the hanger of the invention includes a hook portion 10, an intermediate body portion 12 and a lower portion 14. A clamping sleeve 16 is disposed between body portion 12 and lower portion 14.

Hook portion 10 includes an upper member 18 and a lower member 20, defining an opening 22 therebetween adapted to receive a rod 24. Opening 22 between upper and lower members 18, 20 is dimensioned such that rod 24 is securely clamped between upper and lower portions 18, 20 when hook portion 10 is secured thereto. In this manner, longitudinal or rotational movement of the hanger is prevented after hook portion is mounted to rod 24.

Extending below lower member 20 of hook portion 10 is a neck 26 associated with intermediate body portion 12. Neck 26 is connected at its upper end to hook portion 10, and at its lower end to an angled shank portion 28.

Figure 4:
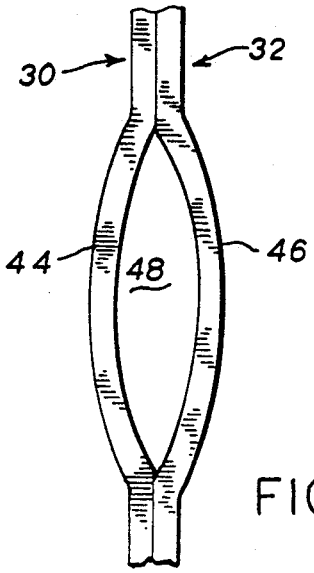
FIG. 4 is a partial right end elevational view of the hanger of FIG. 1.

Referring to FIGS. 1 and 4, lower portion 14 is defined by a pair of lower legs, the front one of which is shown at 30 and the rear one of which is shown at 32 (FIG. 4). Each of legs 30, 32 includes a lower transverse portion adapted to receive a garment therebetween and to be positioned substantially horizontally when hook portion 10 is mounted to rod 24. Referring to FIG. 1, the transverse lower portion of each of legs 30, 32 is connected at its rightward end to an upwardly extending vertical portion, which is connected to an angled portion substantially in line with angled shank portion 28 of intermediate body portion 12. At the uppermost end of the upper angled portions of legs 30, 32, each of legs 30, 32 is connected to the lowermost end of angled shank portion 28 of intermediate portion 12.

Legs 30, 32 are connected to shank portion 28 so as to be movable to an open position defining a space between legs 30, 32 and a closed position in which legs 30, 32 contact each other. When a garment is placed between the lower transverse portion of legs 30, 32 and legs 30, 32 are moved to their closed position, the garment is clamped between legs 30, 32 so as to secure the garment to the hanger.

Figure 5:
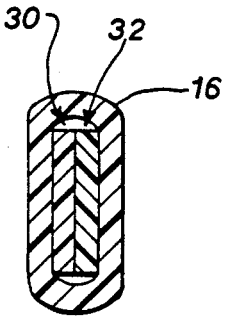
FIG. 5 is a sectional view along line 5—5 of FIG. 1.

Clamping sleeve 16 is slidably mounted to angled shank portion 28 of intermediate body portion 12, and is selectively movable over the upper portions of lower legs 30, 32 adjacent the point of their connection to shank portion 28. As shown in FIG. 5, movement of clamping sleeve 16 over the upper ends of legs 30, 32 squeezes legs 30, 32 together. This results in movement of legs 30, 32 to their closed position. Legs 30, 32 are maintained in their closed position until sleeve 16 is slid upwardly on shank portion 28 out of engagement with legs 30, 32 so as to release the clamping force exerted on legs 30, 32.

Front leg 30 is provided with an offset area, shown at 33, between its lower transverse portion and its upwardly extending vertical portion. Rear leg 32 does not have such an offset portion, thus providing an exposed surface below offset portion 33. This arrangement provides a gripping area for the user's thumb to facilitate withdrawal of the garment from between legs 30, 32.

Figure 2:
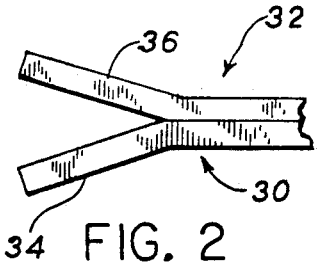
FIG. 2 is a partial top plan view of the end portion of the lower legs of the hanger of FIG. 1, reference being made to line 2—2 of FIG. 1.

Referring to FIG. 2, the leftward end of each of legs 30, 32 is provided with an outward flare 34, 36, respectively. Flares 34, 36 accommodate insertion of a garment between legs 30, 32 from the leftward end of legs 30, 32.

Figure 3:
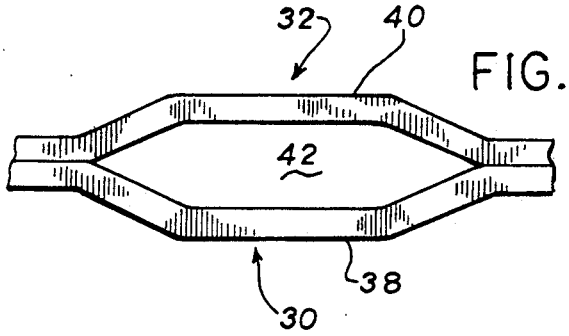
FIG. 3 is a partial top plan view of the medial portion of the lower legs of the hanger of FIG. 1, reference being made to line 3—3 of FIG. 1.

As shown in FIG. 3, the medial area of each of legs 30, 32 is provided with an outwardly protruding portion 38, 40, respectively, defining a space 42 therebetween. When legs 30, 32 are urged to their closed position by movement of clamping sleeve 16 over the upper ends of legs 30, 32 and a garment is positioned therebetween, space 42 acts to receive the vertical seam of the garment. In this manner, the seam of the garment does not disrupt the clamping force exerted on the garment by legs 30, 32, which otherwise would be the case of space 42 were not provided. The garment is thus firmly retained on the hanger between legs 30, 32.

With reference to FIG. 4, the upstanding vertical portion of each of legs 30, 32 is provided with an outwardly protruding portion 44, 46, respectively, defining a space 48 therebetween. The lowermost point of space 48 is disposed immediately above the lower transverse portions of legs 30, 32. Space 48 receives the portion of the garment extending above the lower transverse portions of legs 30, 32 when it is clamped therebetween.

In operation, the hanger of the invention functions as follows. The user first clamps the hanger onto rod 24 by mounting hook portion 10 onto rod 24 such that rod 24 is received within opening 22 and the hanger is firmly clamped thereon so as to prevent movement. When it is desired to place a garment onto the hanger, sleeve 16 is slid upwardly onto shank portion 28 so as to release legs 30, 32. The garment is then slid either from left to right through flares 34, 36 into the space between legs 30, 32, or right to left through space 48 between protrusions 44, 46. The desired movement is continued until the garment is fully in place on the lower transverse portions of legs 30, 32. If a vertical seam in the garment is present, the seam is positioned into space 42 between protrusions 38, 40 in legs 30, 32. Once the proper position of the garment is attained, clamping sleeve 16 is slid downwardly into engagement with the upper ends of legs 30, 32. This downward movement of sleeve 16 is continued until the garment is firmly clamped between legs 30, 32. When it is desired to remove the garment from the hanger, clamping sleeve 16 is once again moved upwardly onto intermediate slanted portion 28 so as to release the clamping force on legs 30, 32, and the garment is slid outwardly from legs 30, 32 off of the hanger. If desired, it is possible to remove the garment from the hanger without moving clamping sleeve 16 to its upper position, simply by pulling horizontally on the garment until it is released from legs 30, 32.

Various alternatives and embodiments are contemplated as being within the scope of the following claims particularly pointing out and distinctly claiming the subject matter regarded as the invention.

I claim:

1. A clothing hanger, comprising:

a hook for placement on a rod for suspending said hanger therefrom;

an intermediate body portion connected to said hook;

a pair of legs connected to and depending from said intermediate body portion, each said leg including a transverse lower portion extending between a first end and a second end with the first end of each leg being interconnected with said body portion, wherein said transverse lower portions of said legs are separable from each other throughout their length so as to receive a garment therebetween, and to allow the garment to be inserted between or removed from said legs from one of said ends of said transverse lower leg portions, wherein the first end of each leg is interconnected with said body portion by means of an upwardly extending portion connected to the first end of the transverse lower portion of each said leg and also connected to said body portion; and selectively engageable clamping means acting on said legs for selectively exerting a clamping force on said garment by urging the transverse lower portions of said legs toward each other, said clamping means being releasable for releasing said clamping force so as to facilitate insertion of said garment between said legs of removal of said garment from said legs;

wherein the upwardly extending portion of each said leg is provided with an outwardly protruding portion so as to define a spaced therebetween when the clamping means is in a position which exerts a clamping force on the garment, for receiving the portion of said garment extending above and beyond the transverse lower portions of said legs during insertion or removal of said garment.

2. A clothing hanger for suspension from a rod, comprising:

a hook including a rod-receiving opening dimensioned such that said hook securely engages said rod so as to prevent longitudinal and rotational movement of said hanger relative to said rod;

an intermediate body portion extending downwardly from said hook;

a pair of substantially parallel legs, each said leg being interconnected with said body portion and including a lower transverse portion extending between a first end and a second end, with the first end of each lower transverse portion being interconnected with said body portion by means of a portion extending upwardly therefrom for connecting each said leg to said body portion, wherein said transverse lower portions of said legs are separable from each other throughout their length and are movable between a clamping position in which said transverse lower leg portions are moved toward each other throughout their full length so as to engage a garment located therebetween and a release position in which said transverse lower leg portions are moved away from each other throughout their full length, wherein a garment can be inserted between or removed from said legs from either the first end or the second end of said lower transverse portions of said legs; and selectively engageable clamping means acting on the portions of said legs extending upwardly from the first end of the lower transverse leg portions, for selectively moving the transverse lower leg portions between their clamping position and their release position, said clamping means comprising a sleeve member slidably mounted to said body portion and selectively engageable with said legs.

3. The hanger of claim 2, wherein the portion of each said leg extending upwardly from the first end of each lower transverse leg portion is provided with an outwardly protruding portion so as to define a space therebetween for receiving the portion of said garment extending above the lower transverse leg portions during insertion or removal of said garment.

4. The hanger of claim 2, wherein the lower transverse portion of each said leg is provided with an outward flare at its second end so as to define a substantially V-shaped entrance to said hanger for said garment.

5. The hanger of claim 2, wherein the lower transverse portion of each of said legs is provided with an outwardly protruding portion so as to define a space therebetween adapted to receive a seam in said garment when said transverse lower leg portions are moved to their clamping position.

6. A clothing hanger, comprising:

a hook for placement on a rod for suspending said hanger therefrom;

an intermediate body portion connected to said hook;

a pair of legs connected to and depending from said intermediate body portion, each said leg including a transverse lower portion extending between a first end and a second end with the first end of each leg being interconnected with said body portion, wherein said transverse lower portions of said legs are separable from each other throughout their length and are movable between a clamping position in which said transverse lower portions of said legs are moved toward each other throughout their full length so as to engage a garment located therebetween and a release position in which said transverse lower portions of said legs are moved away from each other throughout their full length, wherein a garment can be inserted between or removed from said legs from either the first end or the second end of said transverse lower leg portions; and selectively engageable clamping means acting on said legs for selectively moving the transverse lower portions of said legs between their clamping position and release position.

7. The hanger of claim 6, wherein said hook is dimensioned so as to securely engage said rod for preventing longitudinal and rotational movement of said hanger relative to said rod after said hook is engaged with said rod.

8. The hanger of claim 6, wherein said clamping means comprises a sleeve slidably mounted to said body portion and movable over said legs adjacent their connection to said body portion for urging said legs toward each other.

9. The hanger of claim 6, wherein one end of the transverse lower portion of each said leg is provided with an outward flare, so as to define a substantially V-shaped entrance between said transverse lower leg portions for said garment.

10. The hanger of claim 6, wherein the transverse lower portion of each leg is provided with an outwardly protruding portion intermediate the first and second ends, so as to define a space therebetween to receive a seam in said garment when said transverse lower leg portions are moved to their clamping position.

11. A clothing hanger, comprising:

a hook adapted for placement on a rod for suspending said hanger therefrom;

an intermediate body portion connected to said hook;

a pair of legs connected to and depending from said intermediate body portion, each said leg including a transverse lower portion extending between a first end and a second end with the first end of each leg being interconnected with said body portion, wherein said transverse lower portions of said legs are separated from each other throughout their length so as to receive a garment therebetween, and to allow the garment to be inserted between or removed from said legs from either the first end or the second end of said transverse lower leg portions, wherein the transverse lower portion of one of said legs is vertically offset from the transverse lower portion of the other of said legs adjacent one end of the first-mentioned transverse lower leg portions; and selectively engageable clamping means acting on said legs for selectively exerting a clamping force on said garment by urging the transverse lower portions of said legs toward each other, said clamping means being releasable for releasing said clamping force so as to facilitate insertion of said garment between said legs and removal of said garment from said legs.

* * * * *

UNITED STATES PATENT AND TRADEMARK OFFICE

CERTIFICATE OF CORRECTION

PATENT NO. : 5,083,691

DATED : January 28, 1992

INVENTOR(S) : Richard Handrick

It is certified that error appears in the above-identified patent and that said Letters Patent is hereby corrected as shown below:

Claim 1, Col. 3, Line 67:
Delete "of" and substitute therefor -- or --;

Claim 1, Col. 4, Line 3:
Delete "spaced" and substitute therefor -- space --;

Claim 10, Col. 6, Line 2:
After "of each", insert -- said --;

Signed and Sealed this

Twentieth Day of April, 1993

*Attest:*

MICHAEL K. KIRK

*Attesting Officer*

*Acting Commissioner of Patents and Trademarks*